US010414622B2

(12) United States Patent
Ellis et al.

(10) Patent No.: US 10,414,622 B2
(45) Date of Patent: Sep. 17, 2019

(54) FIBER REEL-IN-BOX CABLE PACKAGING ARRANGEMENT

(71) Applicant: COMMSCOPE, INC. OF NORTH CAROLINA, Hickory, NC (US)

(72) Inventors: Kimberly L. Ellis, Claremont, NC (US); Daniel J. Parke, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 296 days.

(21) Appl. No.: 15/585,943

(22) Filed: May 3, 2017

(65) Prior Publication Data

US 2017/0320689 A1 Nov. 9, 2017

Related U.S. Application Data

(60) Provisional application No. 62/331,106, filed on May 3, 2016.

(51) Int. Cl.
*B65D 5/16* (2006.01)
*B65D 85/04* (2006.01)
*B65H 49/32* (2006.01)

(52) U.S. Cl.
CPC ..... *B65H 49/322* (2013.01); *B65D 5/16* (2013.01); *B65D 85/04* (2013.01); *B65H 49/325* (2013.01)

(58) Field of Classification Search
CPC .... B65H 49/322; B65H 49/325; B65D 85/04; B65D 5/103; B65D 5/16
See application file for complete search history.

(56) References Cited

U.S. PATENT DOCUMENTS

| | | | | |
|---|---|---|---|---|
| 4,168,778 | A | 9/1979 | Buxton | |
| 4,535,929 | A * | 8/1985 | Sherman, II | B65D 5/103 206/459.5 |
| 5,158,499 | A | 10/1992 | Guckenberger | |
| 5,529,186 | A | 6/1996 | Bass | |
| 8,662,433 | B2 | 3/2014 | Huffman et al. | |
| 2002/0125161 | A1 | 9/2002 | Cote | |
| 2007/0295847 | A1 | 12/2007 | Weck et al. | |
| 2011/0144724 | A1 | 6/2011 | Huffman et al. | |

OTHER PUBLICATIONS

CommScope, "Tech Tip, CablePak RIB (Reel in a Box) Instructions," May 2011, 2 pgs.
CommScope, "A Package for every Purpose," Sep. 2011, 2 pgs.
Superior Essex, "Packaging Descriptions," Sep. 2015, 1 pg.
Superior Essex, "Fiber Reel-in-a-Box with QuickCount Marking System," 2 pgs.
Klaus Faber AG, "Quick-Info, Reel-in-Box, The best solution for data cables," 1 pg.

(Continued)

*Primary Examiner* — William E Dondero
(74) *Attorney, Agent, or Firm* — Merchant & Gould P.C.

(57) ABSTRACT

Aspects and techniques of the present disclosure relate to a cable packaging arrangement (e.g., reel-in-box package) including a plurality of tabs appending to the top and bottom portions of the arrangement which are individually shaped to be easily assembled together, respectively, so that the top and bottom portions of the cable packaging arrangement will be closed.

22 Claims, 7 Drawing Sheets

(56) References Cited

OTHER PUBLICATIONS

AFL, "Fiber Optic Cable, Fiber-In-A-Box," PP-1-D0048, Revision 3, Oct. 10, 2011, 1 pg.
Belden, "Capabilities Bulletin," CB0023, Copyright 2012, 1 pg.
Superior Essex Communications, Communications Blog, "Fire Alarm and Security Cables Have Four Convenient and Laborsaving Packaging Options," Apr. 22, 2016, 2 pgs.
broadbandbuyer.com, "CAT53 Cable Reel/Box," obtained from http://www.broadbandbuyer.com/store/ethernet-cables/cat5e-cable-reel-box/?page=1#content, Apr. 22, 2016, 11 pgs.
Perfect Vision, "RG6 Coaxial Cable 1000 Ft Reel Copper Clad with Ground," obtained from http://www.satpro.tv/RG6-Copper-Clad-Cable-1000-Ft-Reel-with-Ground-CCS-PVRG6GDBLK.aspx, Apr. 22, 2016, 2 pgs.
TechToolSupply.com, "Vericom 1000 Feet 18 AWG 2 Conductor Stranded U/UTP CMR," obtained from http://www.techtoolsupply.com/Vericom-1000ft-18-AWG-2-Conductor-Stranded-p/ver-sa182-01936.htm, Apr. 22, 2016, 2 pgs.
Primus Cable, "CAT 3 Cable, Bulk Phone Cable, 2-Pair, CAT 3 UTP, 1000', White," obtained from http://www.primuscable.com/store/p/35-CAT3-Bulk-Cable-UTP-PVC-Solid-24AWG-1000-2-Par-White.aspx, Apr. 22, 2016, 1 pg.
TechToolSupply.com, "Vericom CAT5E Plenum Rated Cable, 1000 Feet Blue," obtained from http://www.techtoolsupply.com/ProductDetails.asp?ProductCode=VER-MBW5U-02400, Apr. 22, 2016, 1 pg.
Vericom, "RG6 Coaxial Cable Dual Shield Copper Clad UL Free Shipping 1000FT," obtained from http://www.satpro.tv/RG6-Dual-Shield-Copper-Clad-UL-Coaxial-Cable-Free-Shipping-1000FT.aspx, Apr. 22, 2016, 1 pg.
"Liberty Cool Spool System," obtained from https://secure.libertycable.com/articles/641/Libert-Cool-Spool-System, Apr. 22, 2016, 2 pgs.
"Why DES?", obtained from http://www.buydes.com/why-des/, Apr. 22, 2017, 3 pgs.

* cited by examiner

FIBER REEL-IN-BOX CABLE PACKAGING ARRANGEMENT

CROSS REFERENCE TO RELATED APPLICATIONS

This application claims the benefit of U.S. Provisional Application No. 62/331,106, filed May 3, 2016, the disclosure of which is hereby incorporated herein by reference.

TECHNICAL FIELD

The present disclosure relates generally to packaging, and more specifically to packaging of cable.

BACKGROUND

Communications cable may be packaged in a number of ways. Often communications cable is wound onto a reel or spool, from which it can easily be unwound for use as needed.

One packaging technique employs a "reel-in-box" configuration. As the name implies, the package includes a box in which a reel of cable is mounted. Inside the box, a reel wound with cable is mounted onto a horizontal post, which is in turn mounted onto plastic endplates within the box. The reel is free to rotate on the post. In use, cable can be fed from the reel through an opening in the box (for example, the lid may be removed from the box or opened). Reel-in-box packaging can be advantageous for shipping and for feeding of the cable, as the box can provide a stationary location from which the cable is fed.

Improvements in assembly of reel-in-box packages are desirable.

SUMMARY

An aspect of the present disclosure relates to a cable packaging arrangement (e.g., reel-in-box package) including a plurality of tabs appending to the top and bottom portions of the arrangement which are individually shaped to be easily assembled together, respectively, so that the top and bottom portions of the cable packaging arrangement will be closed. The cable packaging arrangement has structural stiffness and integrity, so that the arrangement may bear the weight of spooled fiber optic cable.

According to another aspect of the present disclosure, the cable packaging arrangement has a number of fold lines such that the arrangement will fold in a flat manner for easy shipment.

According to a further aspect of the present disclosure, a perforation opening is provided within a side of the cable packaging arrangement to secure an end of the fiber optic cable therein.

According to a further aspect of the present disclosure, a large, perforated, payout window is provided to determine the amount of fiber optic cable remaining in the coil and to rewind fiber optic cable without opening the top of the cable packaging arrangement.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

A feature of the present disclosure relates to an easy assembled cable packaging arrangement. The cable packaging arrangement can include a plurality of parallel, linear or substantially straight scores for providing an easy fold and ship configuration.

Figure 1:
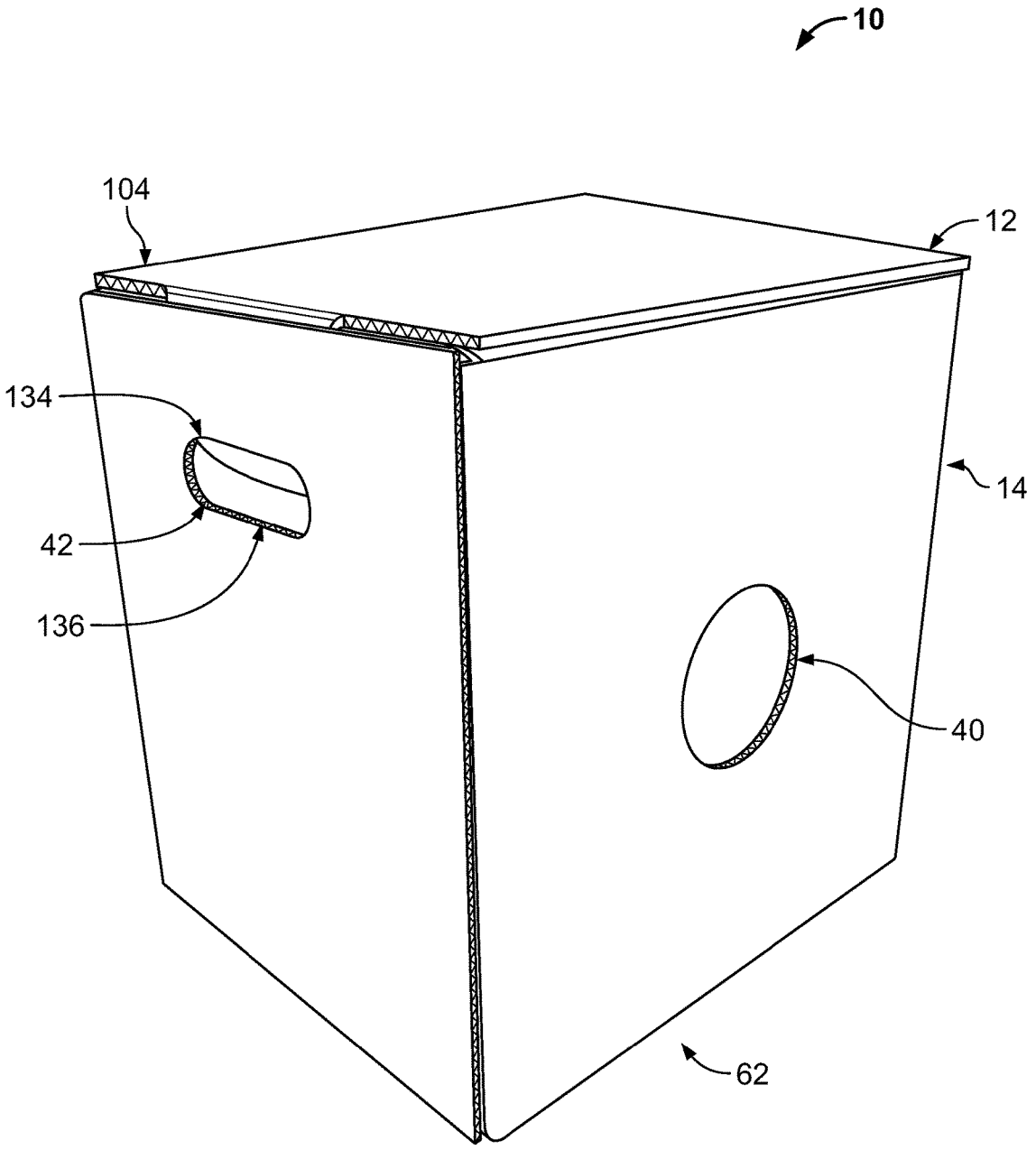
FIG. 1 is a perspective view of an example box in accord with the principles of the present disclosure.
Figure 2:
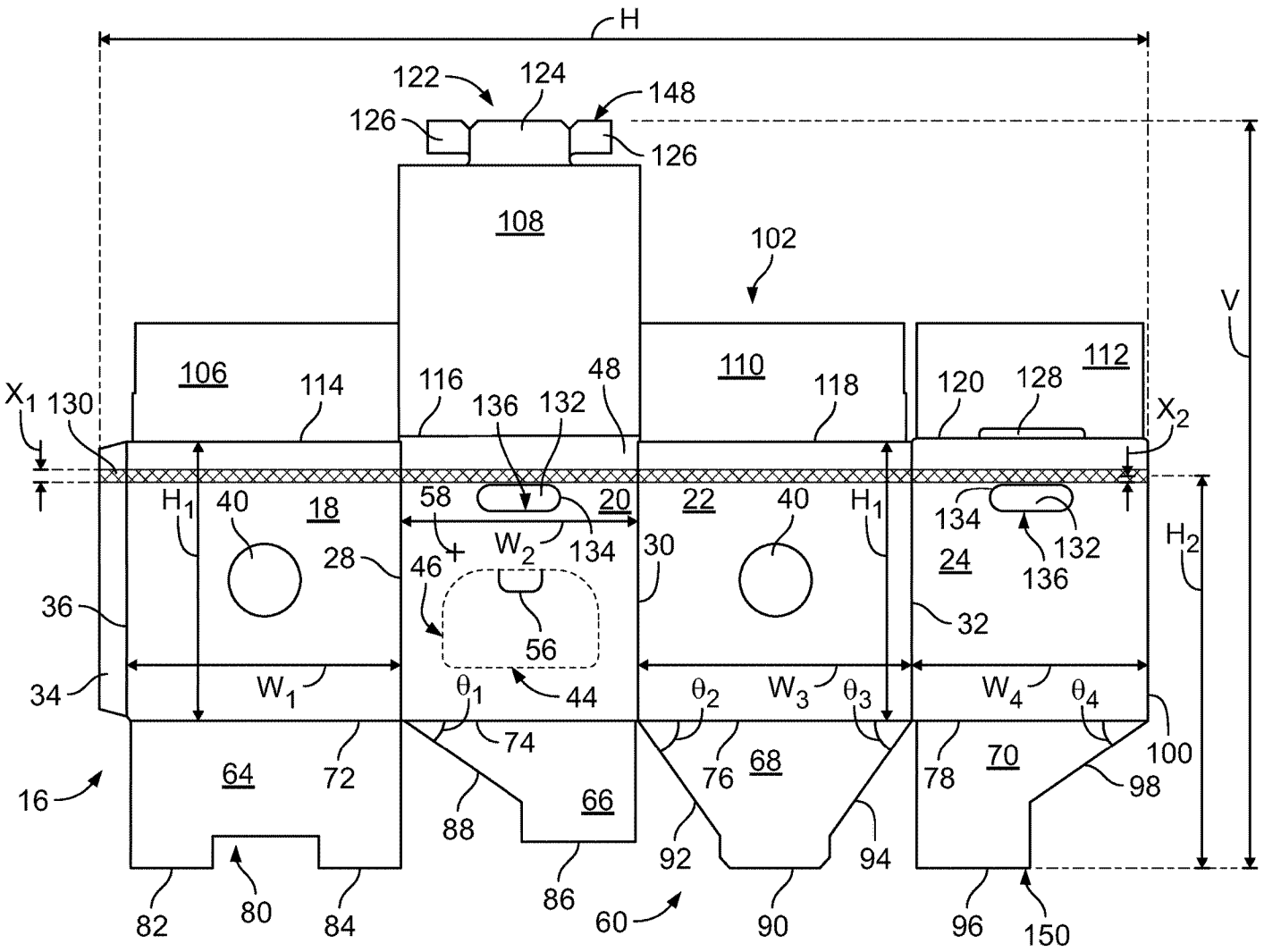
FIG. 2 is a top plan view of a blank for the box shown in FIG. 1.
Figure 3:
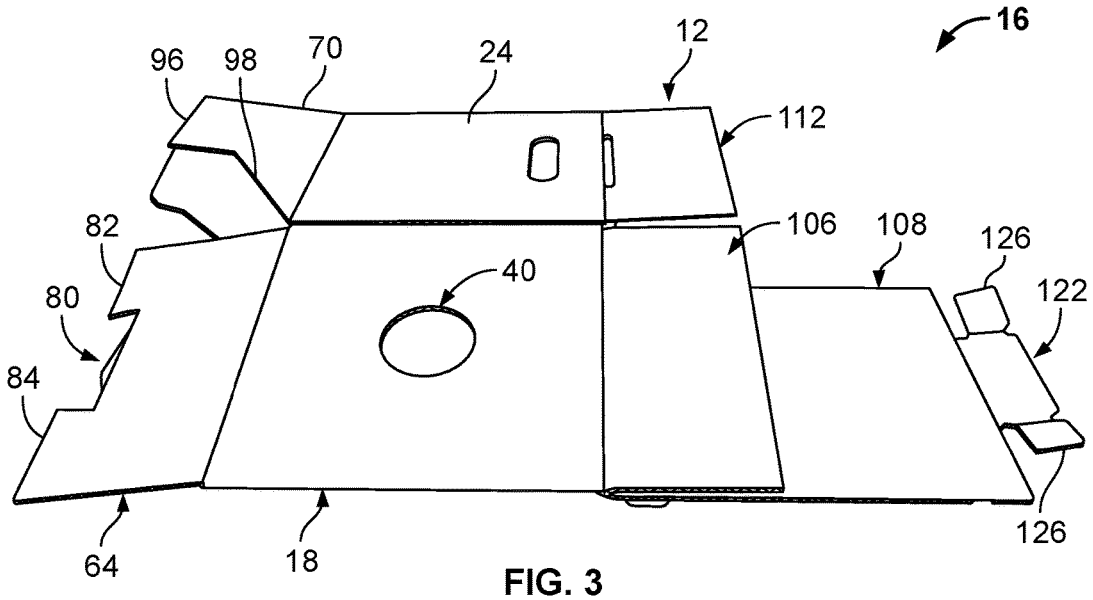
FIG. 3 is a top plan view of the blank shown in FIG. 2 depicting a shipping configuration in accord with the principles of the present disclosure.
Figure 4:
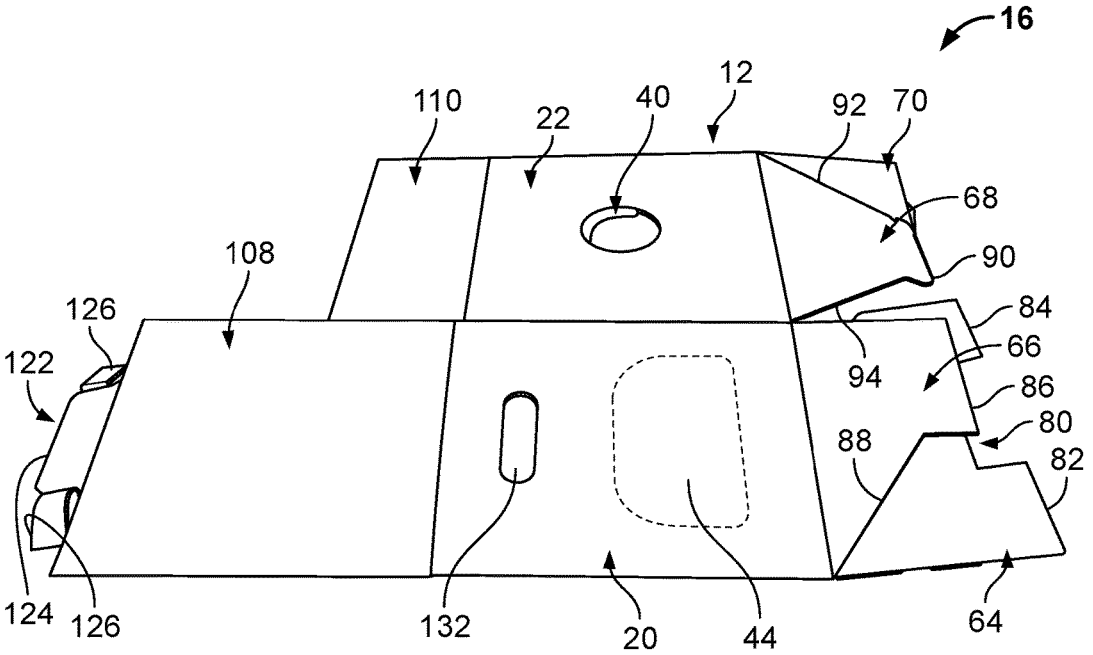
FIG. 4 is a top plan view of the blank shown in FIG. 3 depicting an opposite side thereof.

An example cable packaging arrangement 10, for example, a reel-in-box package, is depicted in FIG. 1. This cable packaging arrangement 10 includes a box 12 with a side panel arrangement 14. Referring to FIG. 2, a top plan view of a blank 16 for the box 12 is depicted. The blank 16 can be made from fiberboard (e.g., cardboard) or the like. The fiberboard can include a corrugated layer 11 (see FIG. 12). The solid lines can represent fold lines and the broken lines can represent a perforated line. The blank 16 can be folded along certain fold lines such that the blank 16 can be easily shipped as two layers as shown in FIGS. 3-4. Details of the fold lines will be described below.

Figure 5:
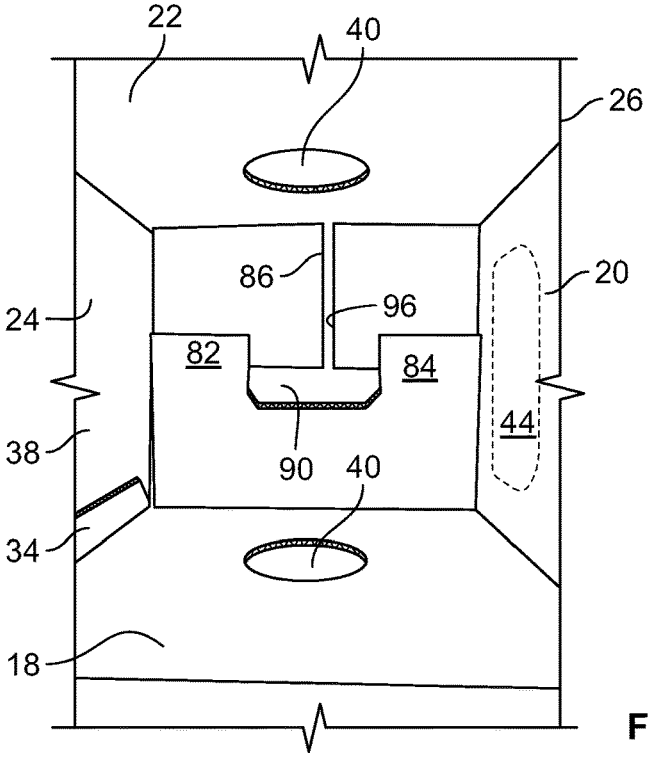
FIG. 5 is a top view of the box shown in FIG. 1 depicting an inside thereof.

As depicted in FIG. 2, the side panel arrangement 14 of the box 12 includes a first side panel 18, a second side panel 20, a third side panel 22, and a fourth side panel 24. The first, second, third, and fourth side panels 18, 20, 22, and 24 can be consecutively positioned about a rectangular perimeter 26 (see FIG. 5) of the box 12 when the box 12 is assembled. The first side panel 18 is shown opposed to the third side panel 22 when the box 12 is assembled. The second side panel 20 is shown opposed to the fourth side panel 24 when the box 12 is assembled.

In the example shown, the first and second side panels 18, 20 are connected at a first side panel fold line 28. The second and third side panels 20, 22 are connected at a second side panel fold line 30. The third and fourth side panels 22, 24 are connected at a third side panel fold line 32. The side panel arrangement 14 can also include an attachment tab 34 connected to the first side panel 18 at a fourth side panel fold line 36. The attachment tab 34 can be adhesively bonded to an interior side 38 of the fourth side panel 24. In the depicted example, the first, second, third, fourth side panels 18, 20, 22, 24 can be integrally formed, although alternatives are possible. The first, second, third and fourth side panel fold lines 28, 30, 32, and 36 can be parallel to one another.

Figure 6:
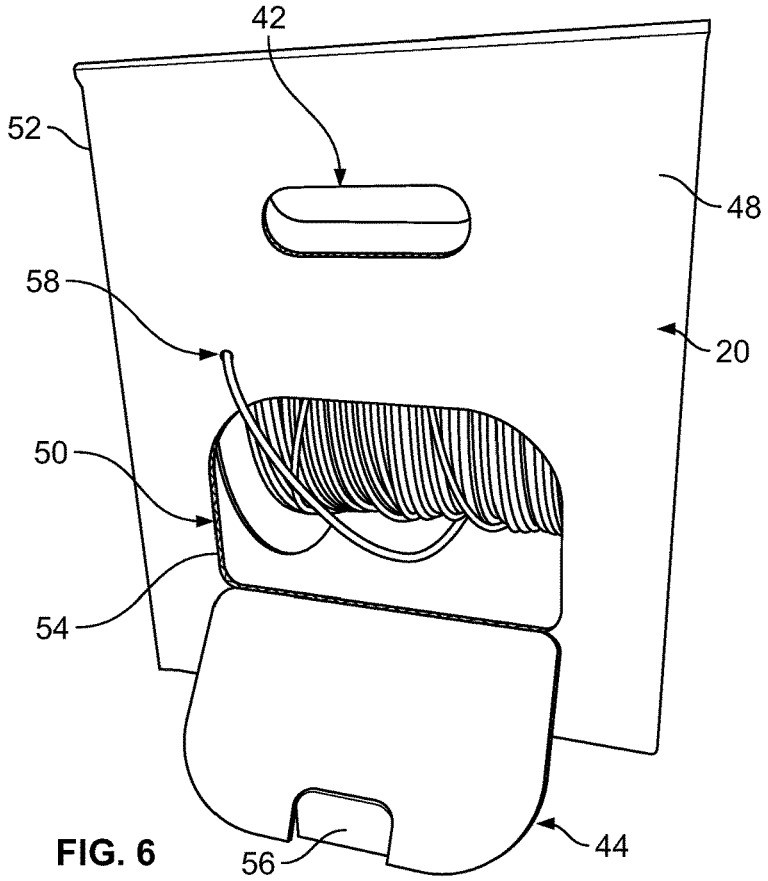
FIG. 6 is a perspective view of the box shown in FIG. 1 depicting features of the box, for example, a cable dispensing window, in accord with the principles of the present disclosure.

The first and third side panels 18, 22 define centrally located circular openings 40. The second and fourth side panels 20, 24 define hand hold openings 42 (see FIGS. 1 and 6). The second side panel 20 can include a removable section 44 defined by a boundary 46 including perforations, slits or the like configured for allowing the removable section 44 to be removed smoothly from a main body 48 of the second side panel 20. In certain examples, the perforations, slits of the boundary 46 can be dimensioned to include ⅛ inch cuts by ⅛ inch gaps. The boundary 46 can define a cable dispensing window 50 (see FIG. 6) when the removeable section 44 has been removed from the main body 48 of the second side panel 20. The cable dispensing window 50 can be dimensioned in the second side panel 20 such that there are two ¼ inch cuts by ⅛ inch gaps, although alternatives are possible. The cable dispensing window 50 shown can have an area that coincides with at least 15 percent of a total area defined by a perimeter 52 (see FIG. 6) of the second side panel 20. The cable dispensing window 50 is generally rectangular, with slightly rounded lower corners and much more prominently rounded upper corners.

The size of the cable dispensing window 50 can provide customers with access to fiber optic cable 54 or other types of wire being paid out. The size of the cable dispensing window 50 further allows the fiber optic cable 54 to be rewind without opening a top of the box 12. For example, if too much fiber optic cable 54 has been paid out and the operator wishes to return the excess fiber optic cable 54 to the reel, the cable dispensing window 50 may be sufficiently spacious to allow an operator's hands to manipulate the reel. The cable dispensing window 50 may also be sufficiently large to provide visual access to the fiber optic cable 54 remaining on the reel, which can enable the operator to quickly assess the amount of fiber optic cable 54 remaining. The cable dispensing window 50 can include a small tab 56 (see FIG. 2). The small tab 56 can be used as a gripping element to tear away the removable section 44 from the main body 48.

The second side panel 20 can include a starburst cut 58 to help prevent a loose end of the fiber optic cable 54 from inadvertently retracting into the box 12. The starburst cut 58 is an asterisk-shaped cut in the second side panel 20 to hold/park an end of the fiber optic cable 54 to help prevent a loose end of the fiber optic cable 54 from dangling to be damaged, tangled or hung-up. The fiber optic cable 54 can be fed out of the box 12 through the cable dispensing window 50 and then back into the box 12 through the starburst cut 58.

Turning again to FIG. 2, the box 12 can include a bottom flap arrangement 60 for closing a bottom 62 (see FIG. 1) of the box 12 when the box 12 is assembled. The bottom flap arrangement 60 shown includes a first bottom flap 64, a second bottom flap 66, a third bottom flap 68, and a fourth bottom flap 70. The first bottom flap 64 can be connected to the first side panel 18 by a first bottom flap fold line 72. The second bottom flap 66 can be connected to the second side panel 20 by a second bottom flap fold line 74. The third bottom flap 68 can be connected to the third side panel 22 by a third bottom flap fold line 76. The fourth bottom flap 70 can be connected to the fourth side panel 24 by a fourth bottom flap fold line 78. The first, second, third and fourth bottom flap fold lines 72, 74, 76, 78 can be perpendicular relative to the first, second, third and fourth side panel fold lines 28, 30, 32, 36.

Figure 7:
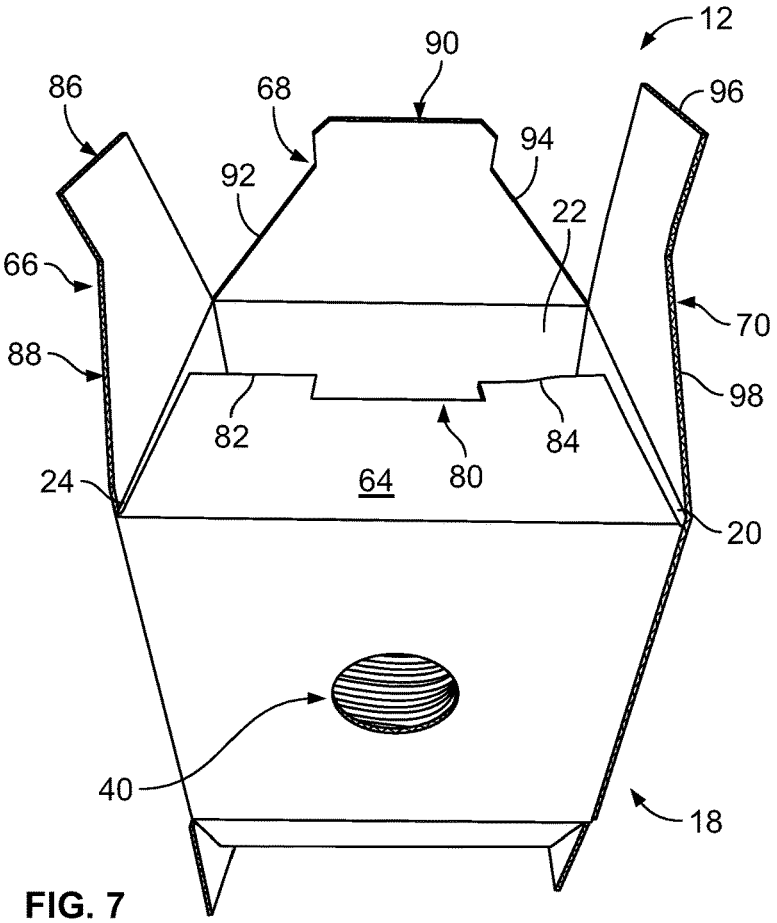
FIGS. 7-9 are sequential views of the box shown in FIG. 1 showing a bottom portion of the box being assembled in accord with the principles of the present disclosure.
Figure 8:
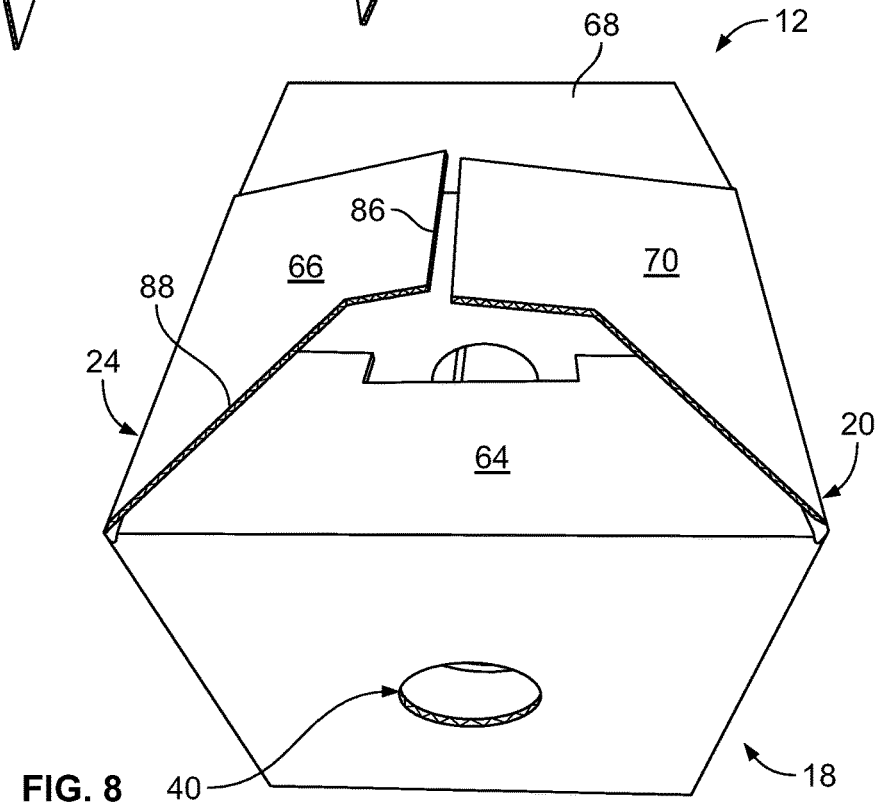
Figure 9:
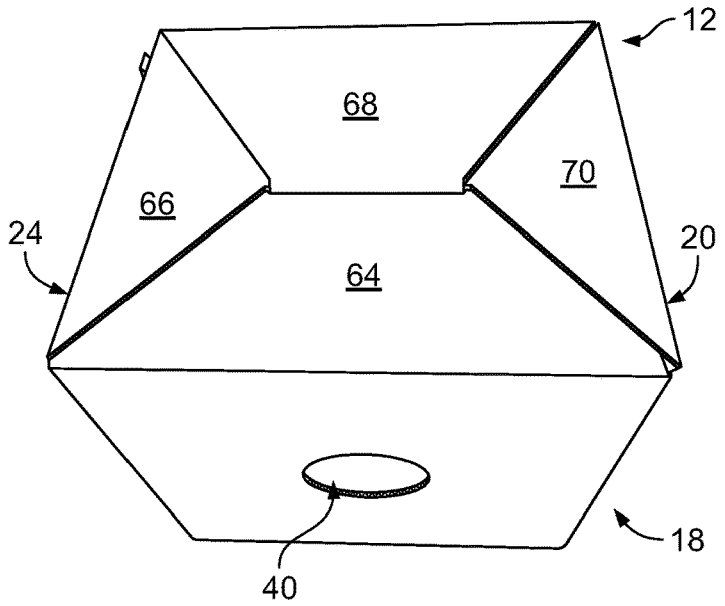

The first bottom flap 64 can be generally rectangular and can be configured to include a rectangular notch 80 positioned between first and second rectangular extensions 82, 84. Referring to FIGS. 7-9, the rectangular notch 80 can be centered between the second and fourth side panels 20, 24 when the box 12 is assembled. The first rectangular extension 82 can be adjacent to the fourth side panel 24 when the box 12 is assembled. The second rectangular extension 84 can be adjacent to the second side panel 20 when the box 12 is assembled.

The second bottom flap 66 can include a third rectangular extension 86 that is positioned adjacent to the third side panel 22 when the box 12 is assembled. The second bottom flap 66 can also include a first angled edge 88 aligned at an oblique angle $\theta_1$ relative to the second bottom flap fold line 74 that extends generally from the first side panel fold line 28 to the third rectangular extension 86. The third bottom flap 68 can include a bottom retaining tab 90 that is centered between the second and fourth side panels 20, 24 when the box 12 is assembled (see FIGS. 7-9).

The third bottom flap 68 can also include a second angled edge 92 aligned at an oblique angle $\theta_2$ relative to the third bottom flap fold line 76 that extends generally from the second side panel fold line 30 to the bottom retaining tab 90. The third bottom flap 68 can further include a third angled edge 94 aligned at an oblique angle $\theta_3$ relative to the third bottom flap fold line 76 that extends generally from the third side panel fold line 32 to the bottom retaining tab 90.

The fourth bottom flap 70 can include a fourth rectangular extension 96 that is positioned adjacent to the third side panel 22 when the box 12 is assembled (see FIGS. 7-9). The fourth bottom flap 70 can also include a fourth angled edge 98 aligned at an oblique angle θ4 relative to the fourth bottom flap fold line 78 that extends generally from a terminal edge 100 of the fourth side panel 24 to the fourth rectangular extension 96. The terminal edge 100 of the fourth side panel 24 can be parallel to the first, second, third, and fourth side panel fold lines 28, 30, 32, 36.

The bottom retaining tab 90 can be arranged and configured to fit within the rectangular notch 80 of the first bottom flap 64 when the box 12 is assembled (see FIGS. 7, 9). The second and fourth bottom flaps 66, 70 can be sandwiched between the first and third bottom flaps 64, 68 when the bottom 62 of the box 12 is assembled closed. The bottom 62 of the box 12 can be self-locking such that no tape or the like is required to hold the bottom 62 of the box 12 closed. The first, second, third, and fourth bottom flaps 64, 66, 68, 70 are shaped and configured to be easily assembled thus reducing significant labor and associated cost by eliminating the need to tape or stable the bottom 62 of the box 12.

Turning again to FIG. 2, the box 12 can include a top flap arrangement 102 for closing a top 104 of the box 12 when the box 12 is assembled (see FIG. 1). The top flap arrangement 102 shown includes a first top flap 106, a second top flap 108, a third top flap 110 and a fourth top flap 112. The first top flap 106 can be connected to the first side panel 18 by a first top flap fold line 114. The second top flap 108 can be connected to the second side panel 20 by a second top flap fold line 116. The third top flap 110 can be connected to the third side panel 22 by a third top flap fold line 118. The fourth top flap 112 can be connected to the fourth side panel 24 by a fourth top flap fold line 120. The first, second, third and fourth top flap fold lines 114, 116, 118, 120 can be arranged and configured perpendicular relative to the first, second, third and fourth side panel fold lines 28, 30, 32, 36.

Figure 12:
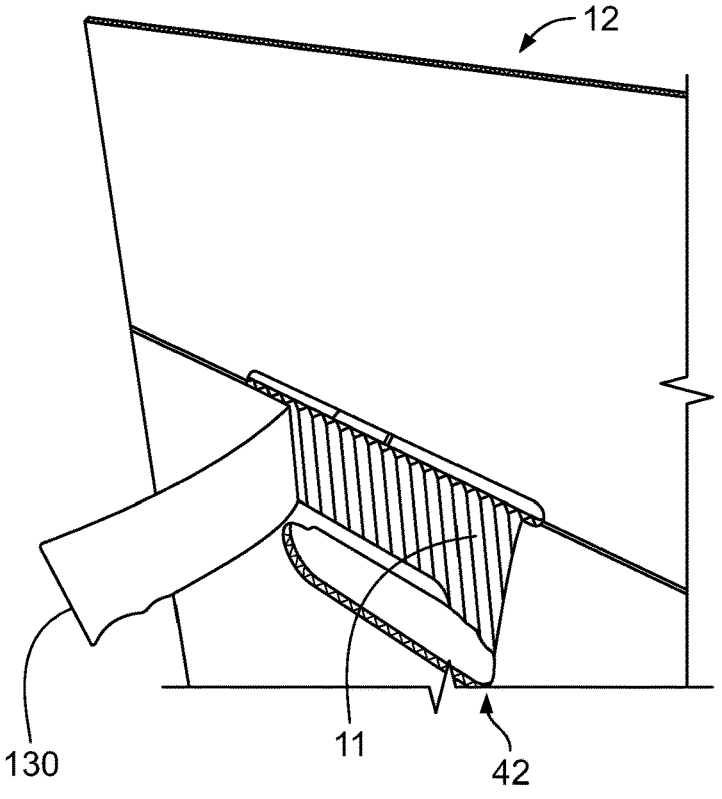
FIG. 12 is a perspective view of the box shown in FIG. 1 depicting a reinforcement tape positioned about a top perimeter of the box in accord with the principles of the present disclosure.

The second top flap 108 can include a top retaining tab 122 that has a central main tab portion 124 positioned between folding retention flaps 126. The fourth top flap 112 can define a top retention slot 128 that receives the top retaining tab 122 to close the top 104 of the box 12 when the box 12 is assembled. The second top flap 108 can be locked into position by bending the central main tab portion 124 about 90° and folding the folding retention flaps 126 inwardly such that the folding retention flaps 126 tuck inside the top retention slot 128 along with the central main tab portion 124. When the top retaining tab 122 is secured within the top retention slot 128, the folding retention flaps 126 can extend outwardly to opposite sides of the hand hold openings 42 to secure the second top flap 108 in a closed position. The second top flap 108 can be moved to an open position by reaching through the hand hold openings 42 to fold the folding retention flaps 126 inwardly such that the folding retention flaps 126 and the central main tab portion 124 can be pulled out from the top retention slot 128. Once the top retaining tab 122 is pulled out of the top retention slot 128, the second top flap 108 can be released and lifted. The first and third top flaps 106, 110 can be sandwiched between the fourth top flap 112 and the second top flap 108 when the top 104 of the box 12 is closed. The top 104 of the box 12 can be self-locking such that no tape or the like is required to hold the top 104 of the box 12 closed. The first, second, third, and fourth top flaps 106, 108, 110, 112 are shaped and configured to be easily assembled thus reducing significant labor and associated cost by eliminating the need to tape or stable the top 104 of the box 12. As depicted in FIG. 2, a tape 130 extends around the perimeter 26 of the box 12 at a location between the hand hold openings 42 and the first, second, third and fourth top flap fold lines 114, 116, 118, 120. Referring to FIG. 12, the tape 130 can be embedded between corrugated layers of the fiberboard of the box 12. The tape 130 helps to reinforce the box 12 and provide integrity when the box 12 is lifted at the hand hold openings 42. For example, the box 12 can be arranged and configured to hold at least 100 lbs., although alternatives are possible. The tape 130 helps to prevent the box 12 from tearing when lifting such loads. The tape 130 can have a dimension $X_1$ within the range of 0.45 inches to 0.85 inches. Typically, the dimension $X_1$ of the tape 130 is 0.63 inches, although alternatives are possible. The dimension $X_2$ of the tape 130 can be positioned about 0.125 inches above the hand hold openings 42, although alternatives are possible.

The second and fourth side panels 20, 24 can include a removable portion 132 having a boundary 134 including perforations 136, slits or the like configured for allowing the removable portion 132 to be removed smoothly from the main body 48 of the second side panel 20 and from the fourth side panel 24. The boundary 134 of the removeable portion 132 defines the hand hold openings 42 when the removeable portion 132 has been removed from the second and fourth side panels 20, 24. A user need only to push with a finger against the removable portion 132 to break the perforations 136 and utilize the hand hold openings 42.

Figure 10:
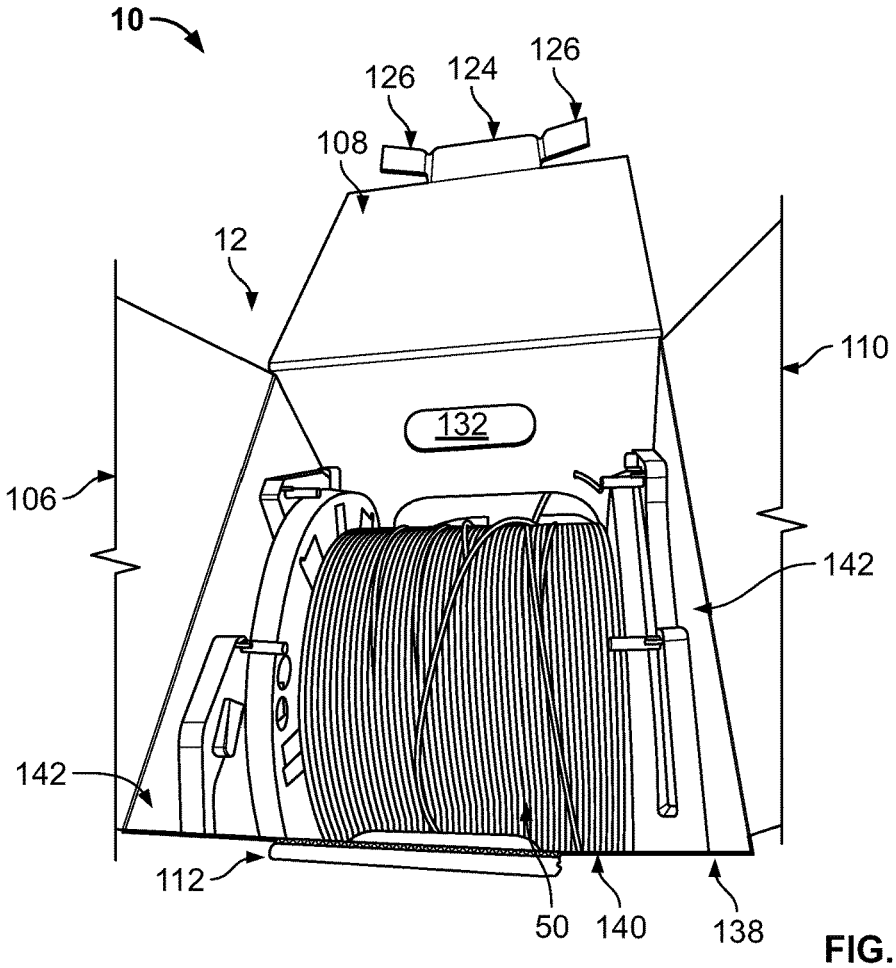
FIGS. 10-11 are sequential views of the box shown in FIG. 1 showing a top portion of the box being assembled in accord with the principles of the present disclosure.
Figure 11:
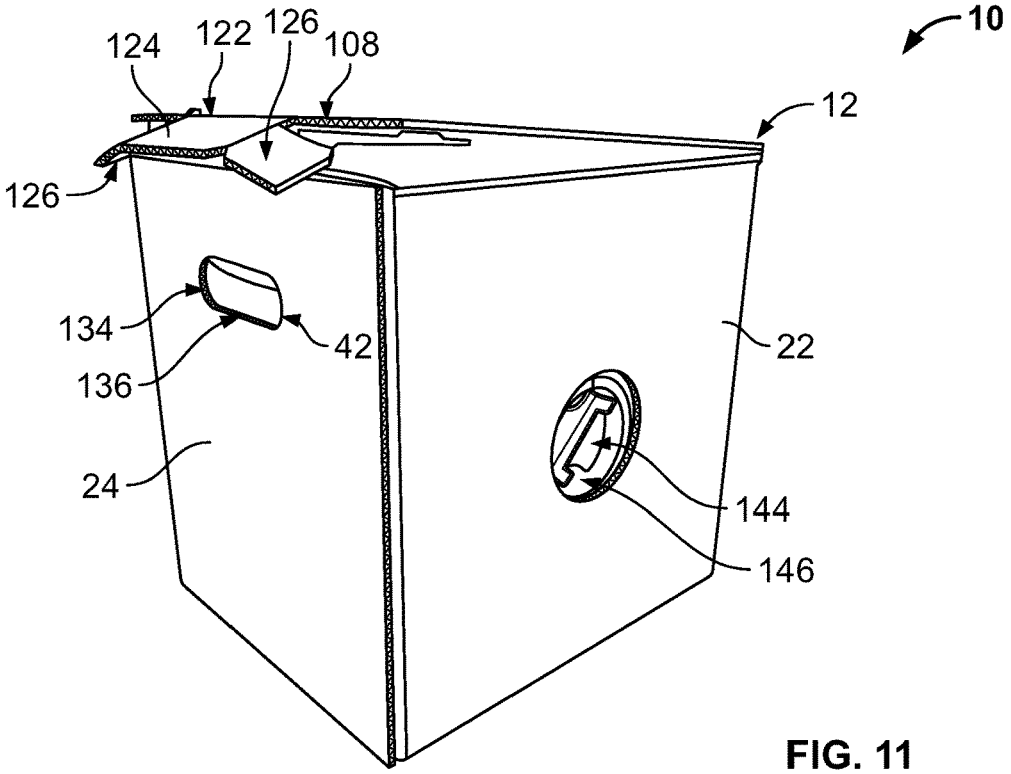

Turning again to FIGS. 10-11, the example box 12 includes a spool assembly 138 that mounts within the box 12 when the box 12 is assembled. The spool assembly 138 shown includes a spool 140 supported on a frame 142 such that the spool 140 can rotate within the box 12 relative to the frame 142. Inside the box 12, the spool 140 is wound with fiber optic cable 54 and is mounted onto the frame 142. For example, the spool 140 can be mounted onto plastic end-plates within the box 12. The spool 140 can be free to rotate. The spool 140 can be arranged and configured such that it does not mount onto a horizontal post; although alternatives are possible.

The spool assembly 138 includes a tensioner 144 that controls a force required to rotate the spool 140 relative to the frame 142. The spool assembly 138 may include dual tensioners 144 positioned on opposite sides of the frame 142. The dual tensioners 144 can extend through the central circular openings 40 of the box 12 and can be visible in or out of the box 12. The dual tensioners 144 can have three adjustable settings for customizing the fiber optic cable 54 payout.

In certain examples, the frame 142 can have opposite projections 146 that fit within respective central circular openings 40 on opposite sides of the box 12. The dual tensioners 144 can be arranged and configured to be incorporated into the respective projections 146 that fit in the central circular openings 40, respectively. The spool assembly 138 can also include the fiber optic cable 54 coiled about the spool 140. In order to dispense the fiber optic cable 54 from the box 12, the fiber optic cable 54 can be pulled from the box 12 though the dispensing window 50 causing the spool 140 to rotate within the box 12. The frame 142 can be constructed of a polymeric or plastic material, although alternatives are possible. Reference is made to one example frame available from Reel Options™ Vandor Corporation, EZ-Brake Boxed End Stands. It will be appreciated that other types of frames may be used in accord with the present disclosure.

Typically, the blank 16 for the box 12 has a dimension in the horizontal direction H that is at least 40 inches, although variations are possible. The horizontal direction H can extend from the terminal edge 100 of the fourth side panel 24 to the attachment tab 34. Often, the dimension in the horizontal direction H is at least 50 inches, although alternatives are possible. Usually, the dimension in the horizontal direction H is no more than 60 inches, although alternatives are possible.

Typically, the blank 16 for the box 12 has a dimension in the vertical direction V that is at least 25 inches, although alternatives are possible. The vertical direction V can extend from an edge 148 of the top retaining tab 122 of the second top flap 108 to an edge 150 (see FIG. 2) of the fourth rectangular extension 96 of the fourth bottom flap 70. Often, the dimension in the vertical direction V is at least 35.68 inches, although alternatives are possible. Usually, the dimension in the vertical direction V is no more than 45 inches, although alternatives are possible.

Typically, the first and third side panels 18, 22 of the box 12 has a dimension of (height) $H_1$, that is at least 12 inches, although variations are possible. Often, the dimension of (height) $H_1$ is at least 13¼ inches, although alternatives are possible. Usually, the dimension of (height) $H_1$ is no more than 15 inches, although variations are possible.

In the depicted example, the dimension of (width) $W_1$ of the first side panel 18 is typically at least 12 inches, although alternatives are possible. Often, the dimension of (width) $W_1$ of the first side panel 18 is at least 13.13 inches, but alternatives are possible. Usually, the dimension of (width) $W_1$ of the first side panel 18 is no more than 15 inches, although alternatives are possible.

In the depicted example, the dimension of (width) $W_2$ of the second side panel 20 is typically at least 10 inches, although alternatives are possible. Often, the dimension of (width) $W_2$ of the first side panel 20 is at least 11.38 inches, but alternatives are possible. Usually, the dimension of (width) $W_2$ of the first side panel 20 is no more than 13 inches, although alternatives are possible.

In the depicted example, the dimension of (width) $W_3$ of the third side panel 22 is typically at least 12 inches, although alternatives are possible. Often, the dimension of (width) $W_3$ of the first side panel 22 is at least 13.13 inches, but alternatives are possible. Usually, the dimension of (width) $W_3$ of the third side panel 22 is no more than 15 inches, although alternatives are possible.

In the depicted example, the dimension of (width) $W_4$ of the fourth side panel 24 is typically at least 10 inches, although alternatives are possible. Often, the dimension of (width) $W_4$ of the fourth side panel 24 is at least 11.25 inches, but alternatives are possible. Usually, the dimension of (width) $W_4$ of the fourth side panel 24 is no more than 13 inches, although alternatives are possible.

In the depicted example, the dimension of (height) $H_2$ of the edge 150 (see FIG. 2) of the fourth rectangular extension 96 of the fourth bottom flap 70 to the tape 130 is typically at least 14 inches, although alternatives are possible. Often, the dimension of (height) $H_2$ is at least 18.81 inches, but alternatives are possible. Usually, the dimension of (height) $H_2$ is no more than 20 inches, although alternatives are possible.

It will be appreciated that the arrangement and configuration of the side panel arrangement, the bottom flap arrangement, and the top flap arrangement can vary with the size of the cable packaging arrangement 10.

From the forgoing detailed description, it will be evident that modifications and variations can be made without departing from the spirit and scope of the disclosure.

What is claimed is:

1. A cable packaging arrangement comprising:

a box including:

a side panel arrangement including a first side panel, a second side panel, a third side panel, and a fourth side panel, the first, second, third, and fourth side panels being consecutively positioned about a rectangular perimeter of the box when the box is assembled, the first side panel opposing the third side panel when the box is assembled, the second side panel opposing the fourth side panel when the box is assembled, the first and second side panels being connected at a first side panel fold line, the second and third side panels being connected at a second side panel fold line, the third and fourth side panels being connected at a third side panel fold line, the side panel arrangement also including an attachment tab connected to the first side panel at a fourth side panel fold line, the attachment tab being adhesively bonded to an interior side of the fourth side panel, the second and fourth side panels defining hand hold openings, the second side panel including a removable section defined by a boundary including perforations configured for allowing the removable section to be removed from a main body of the second side panel, the boundary defining a cable dispensing window when the removable section has been removed from the main body of the second side panel, the cable dispensing window having an area that coincides with at least 15 percent of a total area defined by a perimeter of the second side panel, the first, second, third, and fourth side panel fold lines being parallel to one another;

a bottom flap arrangement for closing a bottom of the box when the box is assembled, the bottom flap arrangement including a first bottom flap, a second bottom flap, a third bottom flap, and a fourth bottom flap, the first bottom flap being connected to the first side panel by a first bottom flap fold line, the second bottom flap being connected to the second side panel by a second bottom flap fold line, the third bottom flap being connected to the third side panel by a third bottom flap fold line, the fourth bottom flap being connected to the fourth side panel by a fourth bottom flap fold line, the first, second, third, and fourth bottom flap fold lines being perpendicular relative to the first, second, third, and fourth side panel fold lines, the first bottom flap being generally rectangular and being configured to include a rectangular notch positioned between first and second rectangular extensions, the rectangular notch being centered between the second and fourth side panels when the box is assembled, the first rectangular extension being adjacent to the fourth side panel when the box is assembled, the second rectangular extension being adjacent to the second side panel when the box is assembled, the second bottom flap including a third rectangular extension that is positioned adjacent to the third side panel when the box is assembled, the second bottom flap also including a first angled edge aligned at an oblique angle relative to the second bottom flap fold line that extends generally from the first side panel fold line to the third rectangular extension, the third bottom flap including a bottom retaining tab that is centered between the second and fourth side panels when the box is assembled, the third bottom flap also including a second angled edge aligned at an oblique angle relative to the third bottom flap fold line that extends generally from the second side panel fold line to the bottom retaining tab, the third bottom flap further including a third angled edge aligned at an oblique angle relative to the third bottom flap fold line that extends generally from the third side panel fold line to the bottom retaining tab, the fourth bottom flap including a fourth rectangular extension that is positioned adjacent to the third side panel when the box is assembled, the fourth bottom flap also including a fourth angled edge aligned at an oblique angle relative to the fourth bottom flap fold line that extends generally from a terminal edge of the fourth side panel to the fourth rectangular extension, the terminal edge of the fourth side panel being parallel to the first, second, third, and fourth side panel fold lines, the bottom retaining tab fitting within the rectangular notch when the box is assembled, and the second and fourth bottom flaps being sandwiched between the first and third bottom flaps when the box is assembled;

a top flap arrangement for closing a top of the box when the box is assembled, the top flap arrangement including a first top flap, a second top flap, a third top flap, and a fourth top flap, the first top flap being connected to the first side panel by a first top flap fold line, the second top flap being connected to the second side panel by a second top flap fold line, the third top flap being connected to the third side panel by a third top flap fold line, the fourth top flap being connected to the fourth side panel by a fourth top flap fold line, the first, second, third, and fourth top flap fold lines being perpendicular relative to the first, second, third, and fourth side panel fold lines, the second top flap including a top retaining tab that has a central main tab portion positioned between folding retention flaps, the fourth top flap defining a top retention slot that receives the top retaining tab to close the top of the box when the box is assembled, the first and third top flaps being sandwiched between the fourth top flap and the second top flap when the top of the box is closed; and a spool assembly that mounts within the box when the box is assembled, the spool assembly including a spool supported on a frame such that the spool can rotate within the box relative to the frame, the spool assembly also including fiber optic cable coiled about the spool, wherein to dispense the fiber optic cable from the box the fiber optic cable is pulled from the box through the cable dispensing window causing the spool to rotate within the box.

2. A cable packaging arrangement according to claim 1, wherein the spool assembly includes dual tensioners that control a force required to rotate the spool relative to the frame.

3. A cable packaging arrangement according to claim 2, wherein the dual tensioners are positioned on opposite sides of the box.

4. A cable packaging arrangement according to claim 2, wherein the dual tensioners have at least three adjustable settings for customizing payout of the fiber optic cable.

5. A cable packaging arrangement according to claim 1, further comprising a tape that extends around the rectangular perimeter of the box at a location between the hand hold openings and the first, second, third, and fourth top flap fold lines, the tape providing reinforcement to the box.

6. A cable packaging arrangement according to claim 5, wherein the box is made of a fiberboard that includes a corrugated layer.

7. A cable packaging arrangement according to claim 6, wherein the tape is positioned between layers of the fiberboard.

8. A cable packaging arrangement according to claim 1, further comprising a starburst cutout for securing an end of the fiber optic cable.

9. A cable packaging arrangement comprising:

a box including:

a side panel arrangement including a first side panel, a second side panel, a third side panel and a fourth side panel, the first, second, third, and fourth side panels being consecutively positioned about a rectangular perimeter of the box when the box is assembled, the first side panel opposing the third side panel when the box is assembled, the second side panel opposing the fourth side panel when the box is assembled, first and second side panels being connected at a first side panel fold line, the second and third side panels being connected at a second side panel fold line, the third and fourth side panels being connected at a third side panel fold line, the side panel arrangement also including an attachment tab connected to the first side panel at a fourth side panel fold line, the attachment tab being adhesively bonded to an interior side of the fourth side panel, the first and third side panels defining centrally located circular openings, the second and fourth side panels defining hand hold openings, the second side panel including a removable section defined by a boundary including perforations configured for allowing the removable section to be removed from a main body of the second side panel, the boundary defining a cable dispensing window when the removable section has been removed from the main body of the second side panel, the cable dispensing window having an area that coincides with at least 15 percent of a total area defined by a perimeter of the second side panel, the first, second, third, and fourth side panel fold lines being parallel to one another;

a bottom flap arrangement for closing a bottom of the box when the box is assembled, the bottom flap arrangement including a first bottom flap, a second bottom flap, a third bottom flap, and a fourth bottom flap, the first bottom flap being connected to the first side panel by a first bottom flap fold line, the second bottom flap being connected to the second side panel by a second bottom flap fold line, the third bottom flap being connected to the third side panel by a third bottom flap fold line, the fourth bottom flap being connected to the fourth side panel by a fourth bottom flap fold line, the first, second, third, and fourth bottom flap fold lines being perpendicular relative to the first, second, third, and fourth side panel fold lines, the first bottom flap being generally rectangular and being configured to include a rectangular notch positioned between first and second rectangular extensions, the rectangular notch being centered between the second and fourth side panels when the box is assembled, the first rectangular extension being adjacent to the fourth side panel when the box is assembled, the second rectangular extension being adjacent to the second side panel when the box is assembled, the second bottom flap including a third rectangular extension that is positioned adjacent to the third side panel when the box is assembled, the second bottom flap also including a first angled edge aligned at an oblique angle relative to the second bottom flap fold line that extends generally from the first side panel fold line to the third rectangular extension, the third bottom flap including a bottom retaining tab that is centered between the second and fourth side panels when the box is assembled, the third bottom flap also including a second angled edge aligned at an oblique angle relative to the third bottom flap fold line that extends generally from the second side panel fold line to the bottom retaining tab, the third bottom flap further including a third angled edge aligned at an oblique angle relative to the third bottom flap fold line that extends generally from the third side panel fold line to the bottom retaining tab, the fourth bottom flap including a fourth rectangular extension that is positioned adjacent to the third side panel when the box is assembled, the fourth bottom flap also including a fourth angled edge aligned at an oblique angle relative to the fourth bottom flap fold line that extends generally from a terminal edge of the fourth side panel to the fourth rectangular extension, the terminal edge of the fourth side panel being parallel to the first, second, third, and fourth side panel fold lines, the bottom retaining tab fitting within the rectangular notch when the box is assembled, and the second and fourth bottom flaps being sandwiched between the first and third bottom flaps when the box is assembled;

a top flap arrangement for closing a top of the box when the box is assembled, the top flap arrangement including a first top flap, a second top flap, a third top flap, and a fourth top flap, the first top flap being connected to the first side panel by a first top flap fold line, the second top flap being connected to the second side panel by a second top flap fold line, the third top flap being connected to the third side panel by a third top flap fold line, the fourth top flap being connected to the fourth side panel by a fourth top flap fold line, the first, second, third, and fourth top flap fold lines being perpendicular relative to the first, second, third, and fourth side panel fold lines, the second top flap including a top retaining tab that has a central main tab portion positioned between folding retention flaps, the fourth top flap defining a top retention slot that receives the top retaining tab to close the top of the box when the box is assembled, the first and third top flaps being sandwiched between the fourth top flap and the second top flap when the top of the box is closed; and a spool assembly that mounts within the box when the box is assembled, the spool assembly including a spool supported on a frame such that the spool can rotate within the box relative to the frame, the spool assembly including at least a first tensioner that controls a force required to rotate the spool relative to the frame, the frame having projections that fit within a respective one of the central circular openings of the box, the spool assembly also including fiber optic cable coiled about the spool, wherein to dispense the fiber optic cable from the box, the fiber optic cable is pulled from the box through the cable dispensing window causing the spool to rotate within the box.

10. A cable packaging arrangement according to claim 9, wherein the box includes: a second tensioner positioned opposite the first tensioner.

11. A cable packaging arrangement according to claim 10, wherein the first and second tensioners are incorporated into respective projections of the frame that fit in the central circular openings.

12. A cable packaging arrangement according to claim 10, wherein the first and second tensioners are visible in or out of the box.

13. A cable packaging arrangement according to claim 10, wherein the first and second tensioners have at least three adjustable settings for customizing the fiber optic cable payout.

14. A cable packaging arrangement according to claim 9, further comprising a tape that extends around the rectangular perimeter of the box at a location between the hand hold openings and the first, second, third, and fourth top flap fold lines, the tape providing reinforcement to the box.

15. A cable packaging arrangement according to claim 14, wherein the box is made of a fiberboard.

16. A cable packaging arrangement according to claim 15, wherein the tape is positioned between layers of the fiberboard.

17. A cable packaging arrangement according to claim 15, wherein the fiberboard includes a corrugated layer.

18. A cable packaging arrangement according to claim 9, further comprising a starburst cutout for securing an end of the fiber optic cable.

19. A cable packaging arrangement according to claim 9, wherein the bottom of the box is self-locking.

20. A cable packaging arrangement according to claim 9, wherein the top of the box is self-locking.

21. A cable packaging arrangement according to claim 9, wherein the cable dispensing window is generally rectangular with prominently rounded upper corners.

22. A cable packaging arrangement according to claim 9, wherein the frame is formed of a plastic material.

* * * * *